US008393032B2

(12) United States Patent
Pichon et al.

(10) Patent No.: US 8,393,032 B2
(45) Date of Patent: Mar. 12, 2013

(54) SUBMERGED SURFACE CLEANING APPARATUS WITH ANGLED PUMPING IMPELLER

(75) Inventors: Philippe Pichon, Villeneuve de Riviere (FR); Emmanuel Mastio, Fourquevaux (FR)

(73) Assignee: Zodiac Pool Care Europe, Paris (FR)

( * ) Notice: Subject to any disclaimer, the term of this patent is extended or adjusted under 35 U.S.C. 154(b) by 200 days.

(21) Appl. No.: 12/808,680

(22) PCT Filed: Dec. 18, 2008

(86) PCT No.: PCT/FR2008/052370

§ 371 (c)(1),
(2), (4) Date: Sep. 20, 2010

(87) PCT Pub. No.: WO2009/081060

PCT Pub. Date: Jul. 2, 2009

(65) Prior Publication Data

US 2011/0000033 A1 Jan. 6, 2011

(30) Foreign Application Priority Data

Dec. 21, 2007 (FR) ..... 07 08998

(51) Int. Cl.
*E04H 4/16* (2006.01)

(52) U.S. Cl. ..... 15/1.7; 210/167.16; 210/232

(58) Field of Classification Search ..... 15/1.7; 210/167.1, 167.16, 167.17, 416.2, 459; 4/490, 4/496; 134/110, 109, 167 R, 168 R; *E04H 4/16*
See application file for complete search history.

(56) References Cited

U.S. PATENT DOCUMENTS 3,892,282 A * 7/1975 Wulc ..... 180/6.5
4,768,532 A * 9/1988 Johnson ..... 134/111

(Continued)

FOREIGN PATENT DOCUMENTS

| | | |
|---|---|---|
| EP | 1022411 | 7/2000 |
| FR | 2567552 | 1/1986 |
| FR | 2586054 | 2/1987 |

(Continued)

OTHER PUBLICATIONS

International Search Report in Application No. PCT/FR2008/052370, Publication Date: 2009.

*Primary Examiner* — Monica Carter
*Assistant Examiner* — Andrew A Horton
(74) *Attorney, Agent, or Firm* — Dean W. Russell; Kilpatrick Townsend & Stockton LLP

(57) ABSTRACT

Detailed is a device for cleaning an immersed surface including a body and members for driving the body over the immersed surface, a filtration chamber which is provided in the body and which has: a liquid inlet located at the base of the body; a liquid outlet arranged opposite the base of the body; a hydraulic circuit for flow of liquid between this liquid inlet and this liquid outlet through a filtering device; a liquid pumping device including a pumping motor which has a rotating drive shaft which is coupled to a pumping propeller which is interposed in the hydraulic circuit, wherein the liquid outlet is longitudinally offset from the liquid inlet and the pumping propeller has an inclined rotation axis which forms, with the longitudinal direction, an angle which is not equal to zero and which is different from 90°.

4 Claims, 7 Drawing Sheets

U.S. PATENT DOCUMENTS

Figure 1:
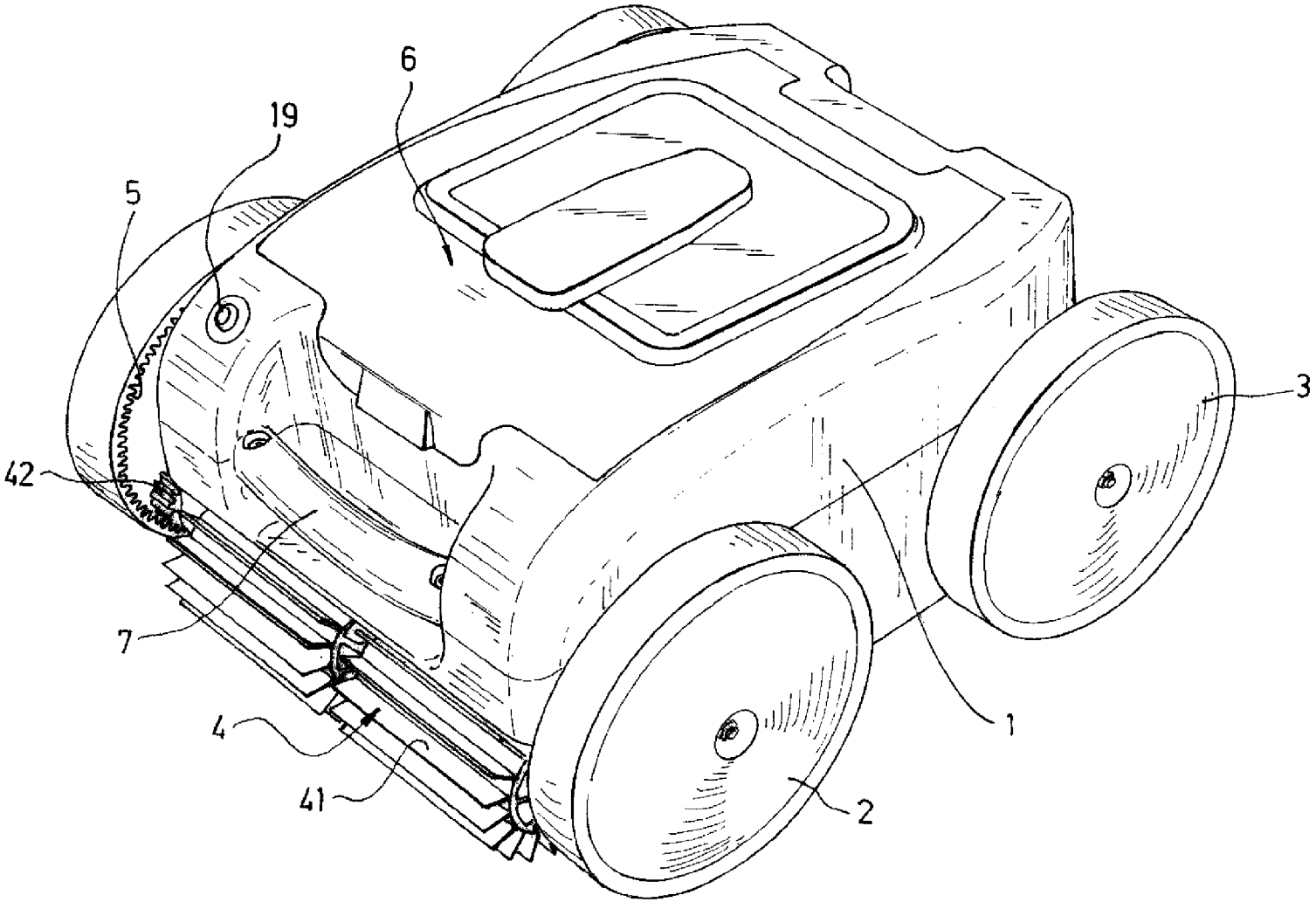

| | | | | |
|---|---|---|---|---|
| 5,842,243 | A * | 12/1998 | Horvath et al. | 15/1.7 |
| 6,409,916 | B1 * | 6/2002 | Zelas et al. | 210/167.16 |
| 6,473,927 | B1 * | 11/2002 | Sommer | 15/1.7 |
| 6,627,074 | B2 * | 9/2003 | Lincke | 210/167.17 |
| 6,886,205 | B1 * | 5/2005 | Pichon | 15/1.7 |
| 2001/0032809 | A1 * | 10/2001 | Henkin et al. | 210/143 |
| 2007/0251032 | A1 * | 11/2007 | Pichon et al. | 15/1.7 |

FOREIGN PATENT DOCUMENTS

| | | |
|---|---|---|
| FR | 2896004 | 7/2007 |
| FR | 2896005 | 7/2007 |
| WO | WO8700883 | 2/1987 |
| WO | WO0250388 | 6/2002 |
| WO | WO02092189 | 11/2002 |

* cited by examiner

SUBMERGED SURFACE CLEANING APPARATUS WITH ANGLED PUMPING IMPELLER

CROSS REFERENCE TO RELATED APPLICATIONS

This application is the U.S. national phase of International Application No. PCT/FR2008/052370 filed on Dec. 18, 2008 and published on Jul. 2, 2009 as International Publication No. WO 2009/081060 A2, which application claims priority to French Patent Application No. 0708998 filed on Dec. 21, 2007, the entire contents of both of which are incorporated herein by reference.

The invention relates to a device for cleaning a surface which is immersed in a liquid, in particular a device for cleaning swimming pool walls.

A number of known swimming pool cleaning devices comprise:

- a hollow body and members for driving the body over the immersed surface in at least one preferred direction of advance and in a main direction of advance, called the longitudinal direction,
- a filtration chamber which is provided in the body and which has:
- at least one liquid inlet into the hollow body, located at the base of the body,
- at least one liquid outlet out of the hollow body, located remotely from the base of the hollow body,
- at least one hydraulic circuit which is capable of providing a flow of liquid between at least one inlet and at least one outlet through at least one filtering device,
- at least one pumping motor—in particular an electric pumping motor which is supplied via a cable which connects the body of the device to an emergent external source of electrical energy—having a rotating drive shaft which is coupled to at least one axial pumping propeller which is interposed in at least one hydraulic circuit in order to generate therein a flow of liquid between each inlet and each outlet.

In these known devices with a motorized pump, the axis of the pumping propeller is generally vertical (cf., for example, FR 2567552 WO 0250388, FR 2586054, EP 1022411) in order in particular to generate an application force by means of suction of the device on the immersed surface.

The inventors have now determined that this arrangement is extremely unfavorable with respect to the performance levels of the device. In particular, this vertical arrangement of the axis of the pumping propeller involves a relatively large vertical spatial requirement which results in the device in a high level of hydraulic resistance to forward movement, and therefore high energy consumption.

Furthermore, this arrangement of the axis of the propeller, owing to the significant weight and the spatial requirement which it involves, increases the cost of producing and using such a device for cleaning an immersed surface.

In this regard, an object of the invention is to provide a device for cleaning an immersed surface whose performance/cost ratio is greatly improved compared with that of prior devices.

More specifically, an object of the invention is to provide such a device whose cost can be substantially reduced, with performance levels which are equivalent to or even greater than those of known devices.

The invention relates to any swimming pool cleaning device of the type mentioned above, which may in particular be driven in an electrical, hydraulic or mixed manner.

However, an object of the invention is more specifically to provide such a device of the type which is self-propelled with (an) on-board electric drive motor(s).

To this end, the invention relates to a device for cleaning an immersed surface comprising:

- a hollow body and members for guiding and driving the body over the immersed surface in at least one preferred direction of advance and in a main direction of advance, called the longitudinal direction,
- a filtration chamber which is provided in the hollow body and which has:
- at least one liquid inlet into the hollow body, located at the base of the hollow body,
- at least one liquid outlet out of the hollow body, located remotely from the base of the hollow body,
- at least one hydraulic circuit which is capable of providing a flow of liquid between at least one liquid inlet and at least one liquid outlet through at least one filtering device,
- at least one liquid pumping device comprising a pumping motor having a rotating drive shaft which is coupled to at least one axial pumping propeller which is interposed in a hydraulic circuit in order to generate therein a flow of liquid between each liquid inlet and each liquid outlet which are connected by this hydraulic circuit, characterized in that:
- each liquid outlet is offset, in the longitudinal direction, from each inlet with which it is in communication via a hydraulic circuit,
- each axial pumping propeller which is interposed in a hydraulic circuit between a liquid inlet and a liquid outlet has an inclined rotation axis forming, with said longitudinal direction, an angle which is not equal to zero and which is different from 90°, said axial pumping propeller being capable of generating a flow of liquid which is orientated along the axis thereof towards this liquid outlet, in the direction away from the base of the body.

The inventors have found that the simple fact of inclining the axis of each axial pumping propeller and the general orientation of each hydraulic circuit in practice at the same time allows the suction and filtering performance levels of the device to be maintained whilst considerably reducing the vertical spatial requirement, and therefore the hydraulic drag thereof. Furthermore, each hydraulic circuit can be configured and sized so as to minimize the pressure losses and to optimize the filtering performance levels. Consequently, with equivalent suction and cleaning performance levels, a device according to the invention may be provided with a driving device which is much less powerful and which therefore has reduced consumption and costs. The device is also generally smaller and lighter which, in addition to the saving made, is a significant advantage for the user, in particular in terms of handling, transport and storage of the device.

Furthermore, at an equivalent height, a device which has an axial pumping propeller which is inclined may have a greater length available for the hydraulic circuit, all other things being equal, which allows the pumping propeller to be arranged at a distance from the pumping motor which is greater than the distance which separates the propeller from the motor in a device with a vertical axial pumping propeller. Consequently, the pressure losses brought about by the presence of the motor over the hydraulic path are lower since the deviations and the complexities of the hydraulic path are minimized. The flow of liquid in the region of the pumping propeller can therefore be substantially parallel with the axis of the pumping propeller.

Furthermore, a device according to the invention which comprises an inclined pump may have a substantial floor guard without for all that having significant overall vertical dimensions. Such a floor guard reduces the risk of the device becoming blocked, for example, over a drainage plug of a pool.

Furthermore, since the liquid inlet is offset longitudinally from the liquid outlet, and the axis of propeller of the pumping device is inclined so as to allow an inclined flow of liquid between this liquid inlet and this liquid outlet, the suction flow of debris present on the immersed surface generated by the pumping device can also be inclined.

This inclined suction flow may allow suction of the debris slightly to the front or to the rear of a liquid inlet of the device, in the movement direction of the device, the inclination of the propeller, the arrangement of the liquid inlets and the shape of the hydraulic circuit. In particular, with a hydraulic circuit which is substantially rectilinear between the liquid inlet and the liquid outlet, an inclination of the propeller in a direction substantially parallel with the direction which connects the liquid inlet to the liquid outlet allows suction of debris which are located at the front of the liquid inlet. This suction can facilitate the suction of debris in the region of the bases of vertical walls of a swimming pool, for example, when such suction would not be possible if the pumping propeller were vertical at right-angles relative to the liquid inlet.

A device according to the invention comprises at least one liquid pumping device which comprises a pumping motor which has a rotating drive shaft which is coupled to at least one axial pumping propeller which has an inclined rotation axis.

The rotating drive shaft of a pumping device which is coupled to a pumping propeller may be vertical, horizontal or may be inclined in any manner relative to the longitudinal direction. However, advantageously and according to the invention, each pumping motor has an inclined rotating drive shaft which forms, with the longitudinal direction, an angle which is not equal to zero and which is different from 90°. Owing to the inclination of the rotation axis of the pumping propeller, this allows the vertical spatial requirement of the device and therefore the hydraulic drag of the device to be reduced.

Advantageously, a device according to the invention comprises, for access to the filtering device, a flap which is provided on an upper wall of the hollow body and which is capable of allowing the filtering device to be disassembled and to pass through this access flap.

In a variant or in combination, a device according to the invention comprises, for access to the filtering device, a flap which is provided on a front wall of the hollow body and which is capable of allowing the filtering device to be disassembled and to pass through this access flap.

In these two variants, the filtering device can be simply removed from the device, via the top of the device and/or via the front of the device, without requiring the device to be inverted. The removal of the filtering device is therefore carried out with the device in a horizontal position, that is to say, with the device in the normal movement position thereof. It is the inclination of the pumping device in a device according to the invention which allows this advantageous removal via the top and/or via the front of the device.

Advantageously and according to the invention, each pumping motor has a rotating shaft which is coaxial relative to the rotation axis of an axial pumping propeller.

Such a variant, on the one hand, allows simple coupling between the axial pumping propeller and the drive shaft and on the other hand, confers a minimal vertical spatial requirement on a device according to the invention.

An axial pumping propeller of a pumping device of a device according to the invention is arranged in a hydraulic circuit of the device so that the axis of the propeller is neither horizontal, nor vertical. A good compromise involves selecting an inclination which allows a satisfactory level of debris suction to be maintained, that is to say, which in particular limits the pressure losses, and a substantial reduction of the vertical spatial requirement of the cleaning device to be ensured in order to correspondingly reduce the hydraulic drag of the device over the immersed surface.

According to a variant of the invention, each pumping propeller has an inclined rotation axis which forms, with the longitudinal direction, an angle of between 15° and 60°, in particular in the order of 30°.

Preferably, the inclination of the rotation axis of the propeller is such that the flow of liquid being discharged from the device has a horizontal component which is greater than the vertical component thereof.

Advantageously and according to the invention, the rotation axis of each pumping propeller interposed in a hydraulic circuit is parallel with the middle inclined direction which extends via the liquid inlet and the liquid outlet which are connected by this hydraulic circuit. The inventors have found that such an inclination allows the liquid flow to be optimized between the liquid inlet and the liquid outlet, which therefore allows the debris suction level to be optimized.

Advantageously and according to the invention, at least one liquid outlet out of the hollow body is substantially coaxial, to within 5°, relative to the rotation axis of an axial pumping propeller.

According to an advantageous variant of the invention, at least one liquid outlet is arranged precisely opposite the pumping propeller so that the liquid flows out of the device via this liquid outlet in a direction which corresponds to that of the flow of liquid generated by the axial pumping propeller.

The inventors have found that this specific arrangement not only allows the suction and filtering performance levels of the device to be maintained whilst significantly reducing the vertical spatial requirement and therefore the hydraulic drag thereof, but also allows at least part of the residual hydraulic energy in the outlet flow to be recovered directly with no pressure loss in order to contribute to driving the device.

Consequently, with equivalent suction and cleaning levels, a device according to the invention may be provided with a driving device which is much less powerful and which therefore has lower consumption and costs. Consequently, the device is also generally smaller and lighter which, in addition to the savings made, is a significant advantage for the user, in particular in terms of handling, transport and storage of the device.

The hollow body of a device according to the invention may be produced from several components which are joined together using any type of assembly means, or by a single component, such as a molded component.

Advantageously and according to the invention, the hollow body is formed principally by a concave housing which delimits a main chamber, this housing having openings which are provided in a lower portion of the housing and in a rear portion of the housing, respectively, these openings forming the liquid inlet(s) and liquid outlet(s), respectively.

Such a housing is formed in one piece by means of molding. Preferably, this housing is produced from a thermoplastic material which is capable of remaining in an aqueous medium for a long period of time. Such a material is, for example, an ABS plastics material which, owing to its constitution, has thermal resistance with respect to ageing, a capacity to withstand impacts and a strength which allow elements to be mounted in the housing and ease of molding.

Such a housing defines a main chamber which is capable of receiving a filtration chamber and at least one liquid pumping device. Each pumping device comprising a propeller with an inclined rotation axis, and a motor having a drive shaft, preferably inclined in the same direction as the axis of the propeller, may be arranged at various locations of the hydraulic circuit for which it provides the flow of liquid.

Advantageously and according to the invention, each pumping motor of each hydraulic circuit is arranged below the inclined direction which extends via the liquid inlet and the liquid outlet which is longitudinally offset relative to this liquid inlet, connected to each other by means of this hydraulic circuit.

Such an arrangement of each pumping device allows the center of gravity of the device to be offset towards the bottom of the device. The pumping devices constitute a significant portion of the total weight of the device.

Advantageously, a device according to the invention also comprises a propeller fairing which surrounds the axial pumping propeller over the entire height thereof.

Such a propeller fairing extends at least over the entire height of the axial pumping propeller. For example, downstream and upstream of the axial pumping propeller, the propeller fairing may extend beyond the propeller and form a liquid outlet channel towards the liquid outlet out of the hollow body of the device.

A device according to the invention can be moved over the immersed surface using any type of means.

In particular, a device according to the invention can be moved using hydraulic means, electrical means or mixed hydraulic and electrical means.

However, advantageously and according to the invention, the members for driving the body over the immersed surface comprise at least one electric drive motor.

An electric motor of this type may be an electric motor which is supplied with electrical power by one or more accumulators which are accommodated in the housing of the device or an electric motor which is supplied with electrical power from a domestic electric network, such as the urban electric network, via an electrical cable. Preferably, such an electric motor is a very low-voltage electric motor.

In the same manner, the pumping motor of each pumping device is preferably a very-low voltage electric motor. Each electric pumping motor may also be supplied with electrical power, either by accumulators which are accommodated in the housing or by means of a domestic electric network, such as the urban electric network, and an electrical cable which connects the device to this domestic electric network. Preferably, the electric motor for driving the cleaning device and each motor of each pumping device are supplied by the same source of electrical energy.

Advantageously and according to the invention, each electric drive motor is a uni-directional drive motor.

Advantageously, a device according to the invention comprises at least one axle which has guide wheels or non-guide wheels and which extends in a direction perpendicular relative to the longitudinal direction.

At least one of these wheels is a drive wheel. Such wheels are advantageously caused to rotate by means of at least one electric drive motor. These wheels are mounted on an axle which extends in a perpendicular direction relative to the main direction of advance. A rotation of the wheels therefore brings about a movement of the robot in the main direction of advance.

A device according to the invention may further comprise a device which allows the movement direction of the device to be changed when it encounters a vertical wall. This device for changing direction may be of any known type.

Advantageously, a device according to the invention comprises a single hydraulic circuit, this circuit comprising one or more liquid inlet(s) located at the base and at the front of the hollow body and one or more liquid outlet(s) located remotely from the base of the body in the region of a rear portion of the body.

Such a device which has at least one liquid inlet located towards the front of the device in the lower portion and at least one liquid outlet located towards the rear of the device and remotely from the base of the device allows debris to be drawn in which are scattered over the immersed surface in the normal movement direction of the device.

Furthermore, a discharge of liquid via an upper rear outlet in an inclined direction which extends in the direction away from the base of the body contributes to keeping the cleaning device pressed against the immersed surface whilst being involved in driving the device over the immersed surface.

Preferably, the device according to the invention comprises only one liquid inlet and only one liquid outlet which are connected by means of a single hydraulic circuit.

Preferably, this single hydraulic circuit comprises a single pumping device which comprises a single electric pumping motor which has a rotating drive shaft which is coupled to a single pumping propeller having an inclined rotation axis.

The invention further relates to a cleaning device, characterized in combination by all or some of the features mentioned above or below.

Figure 2:
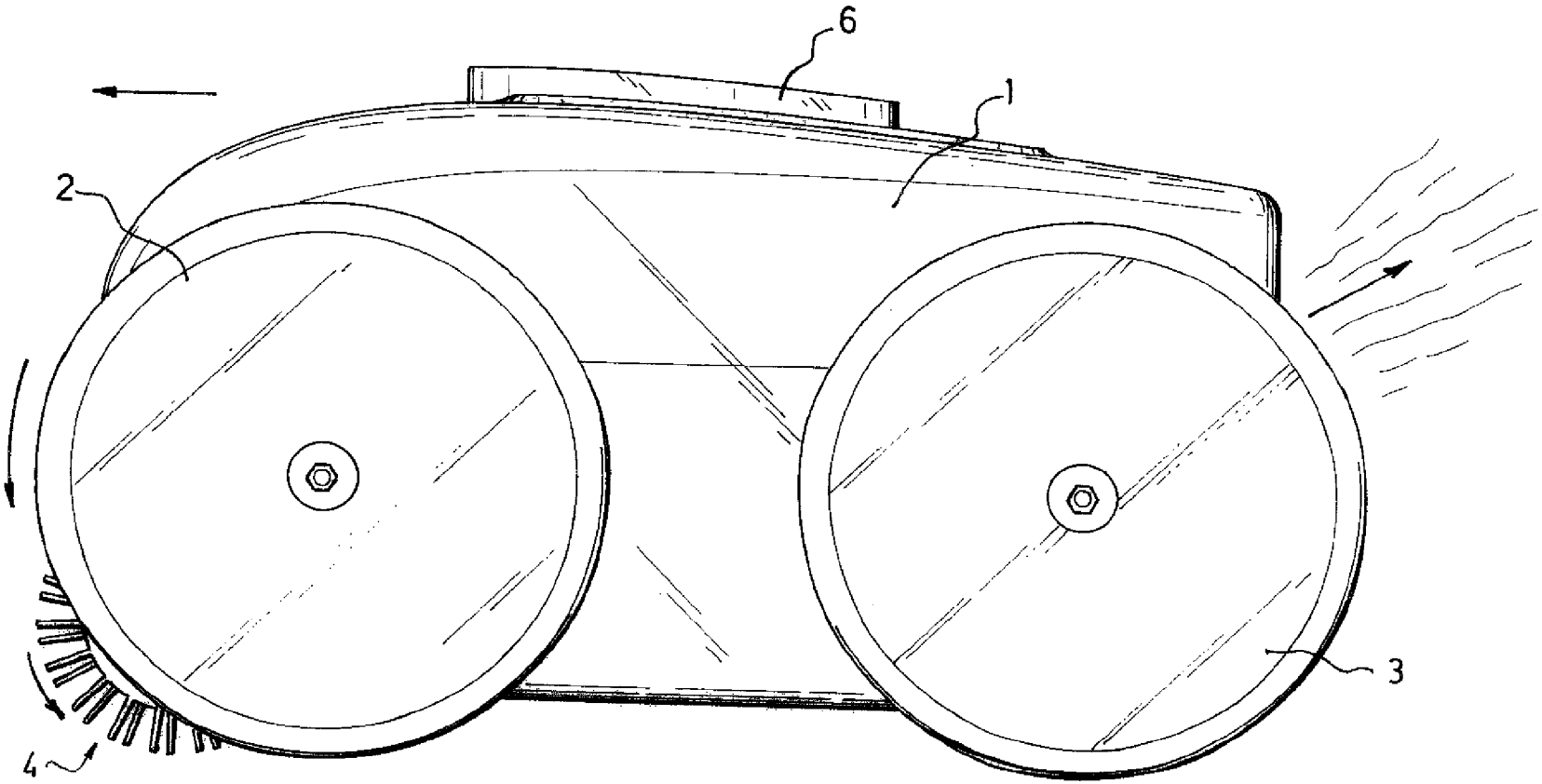
Figure 3:
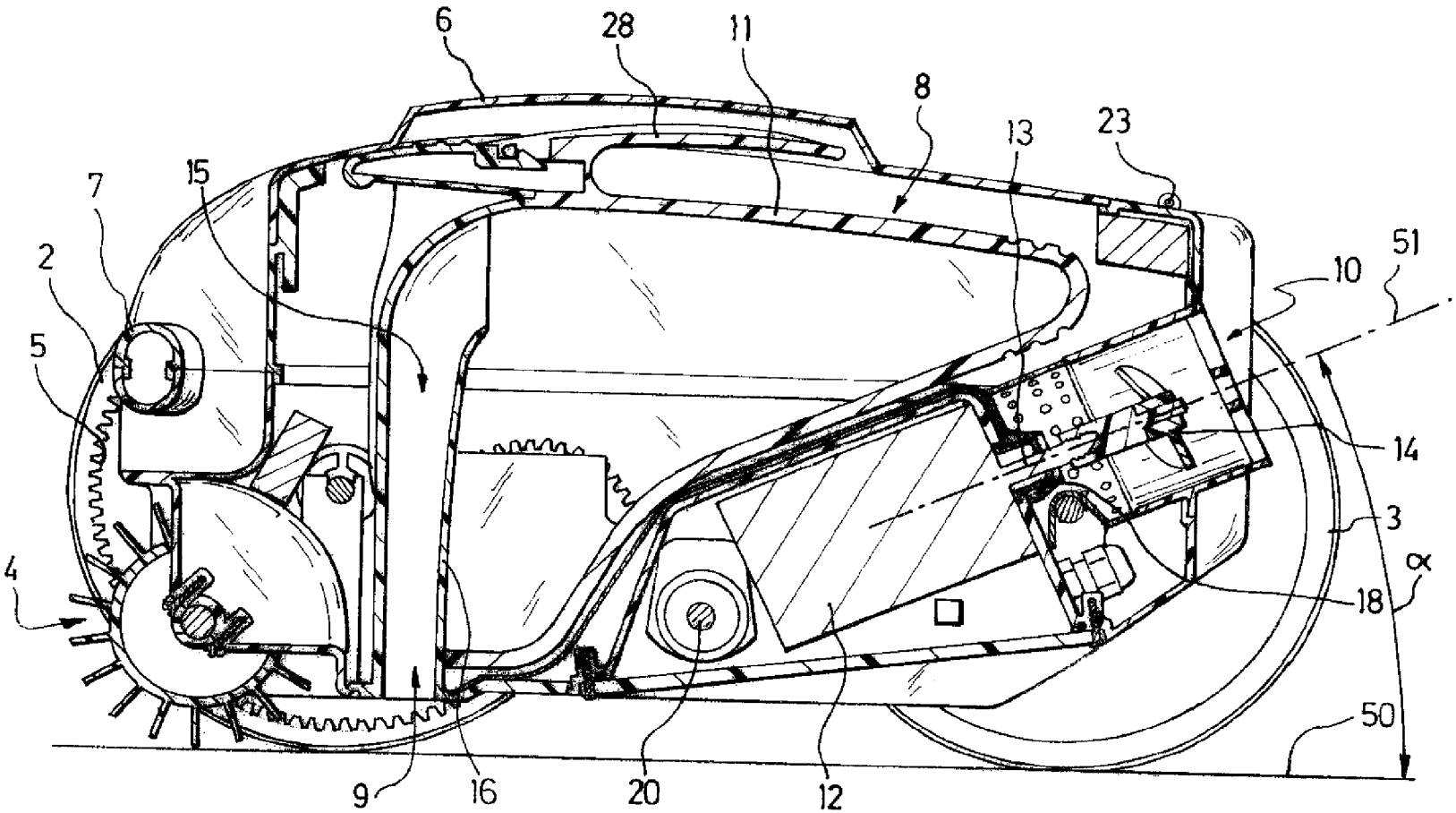
Figure 4:
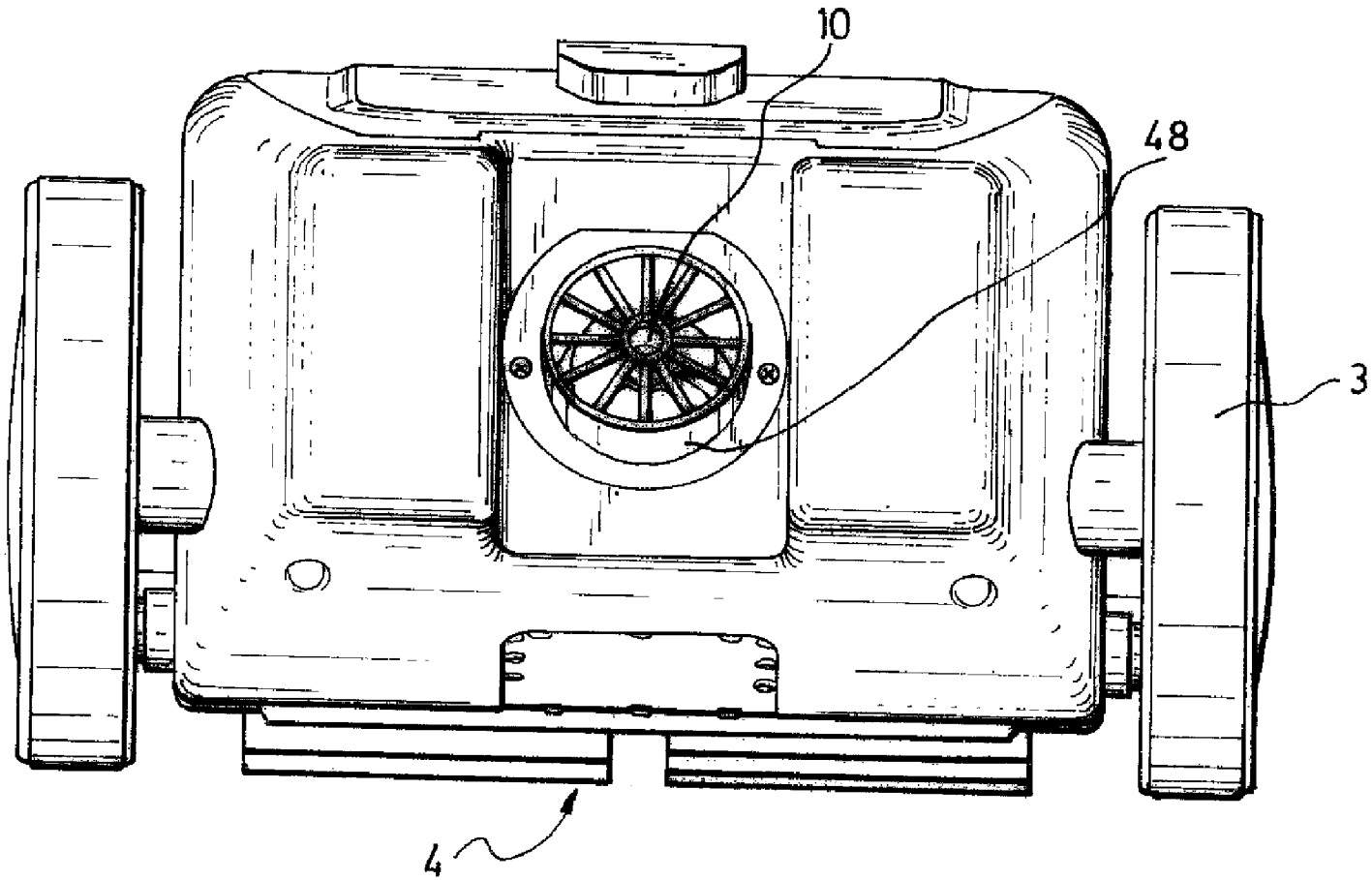
Figure 5:
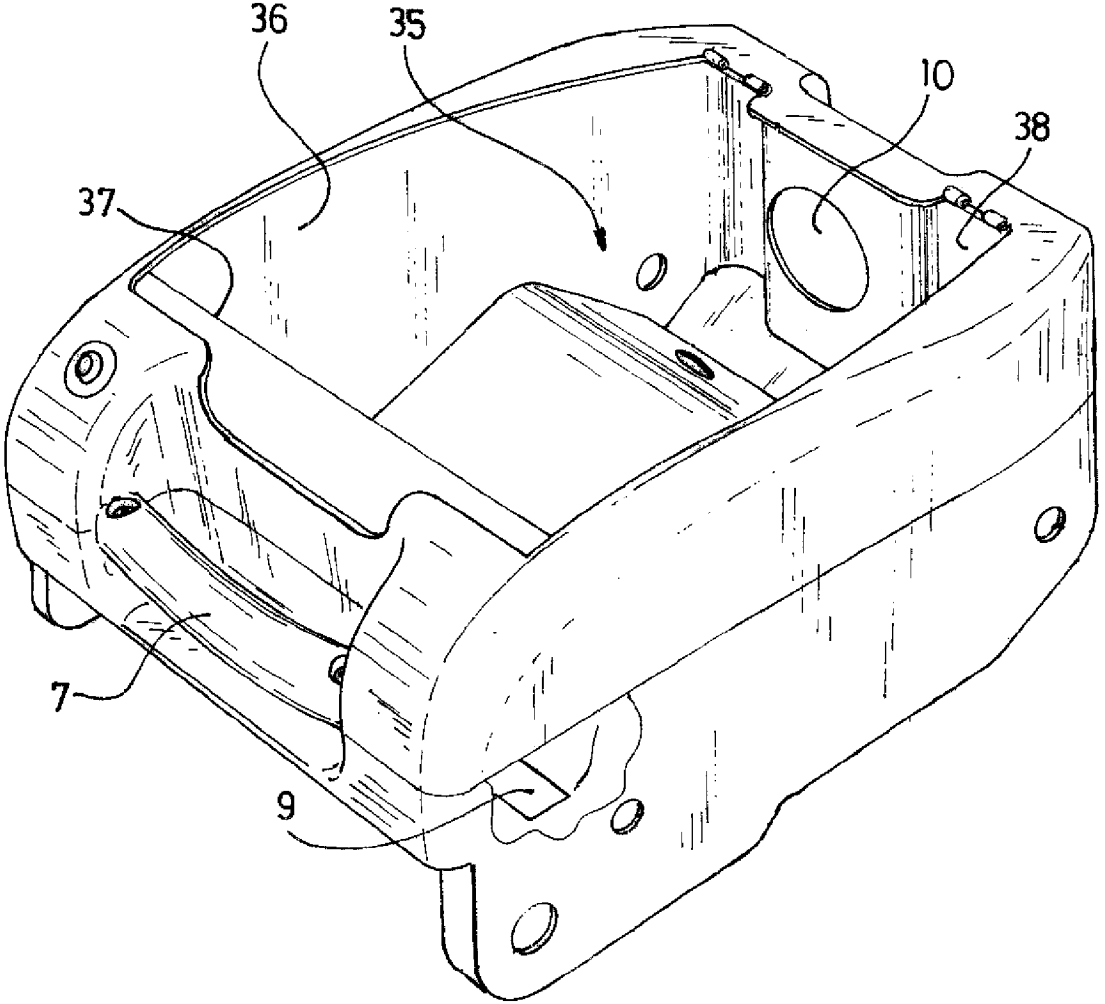
Figure 6:
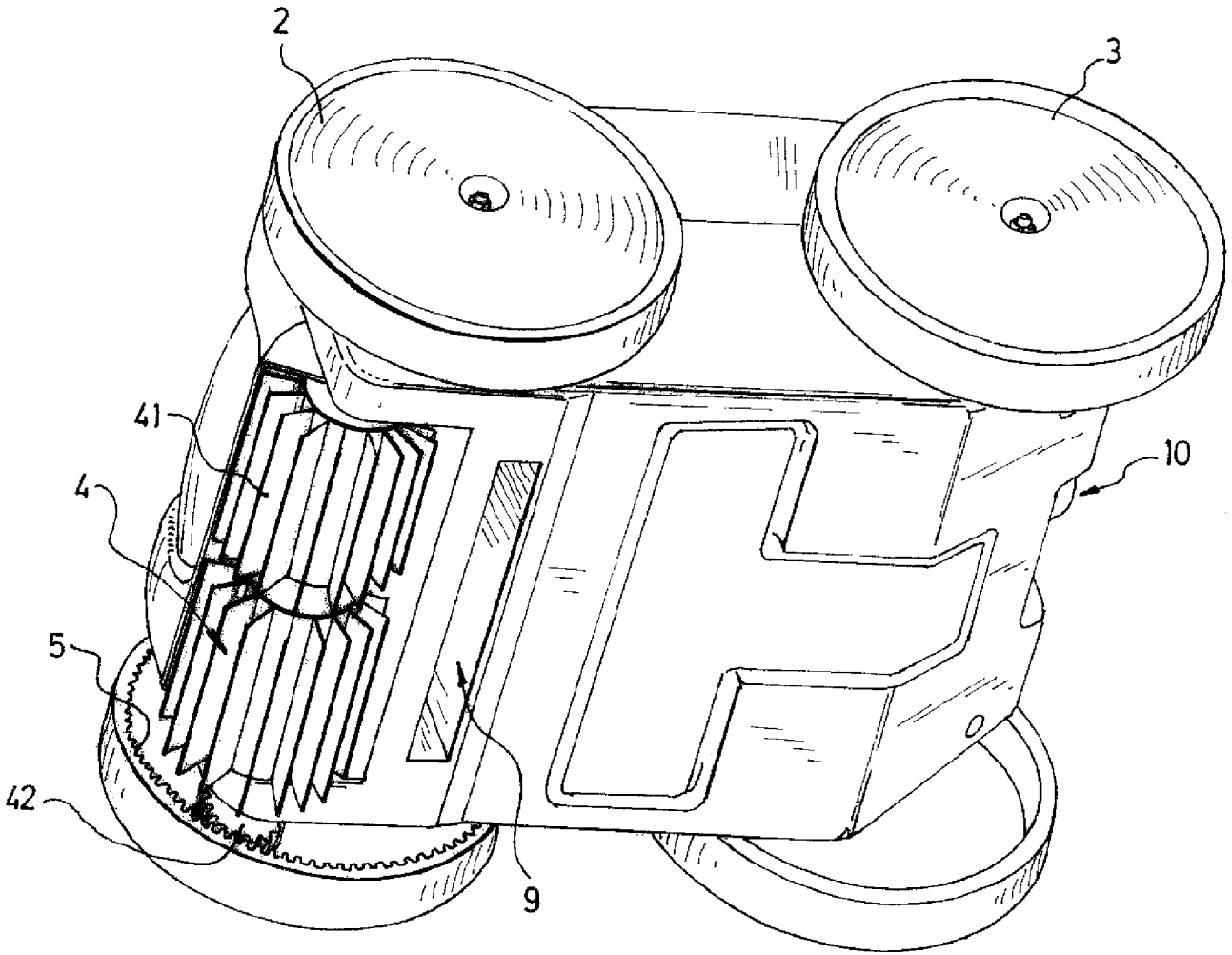
Figure 7:
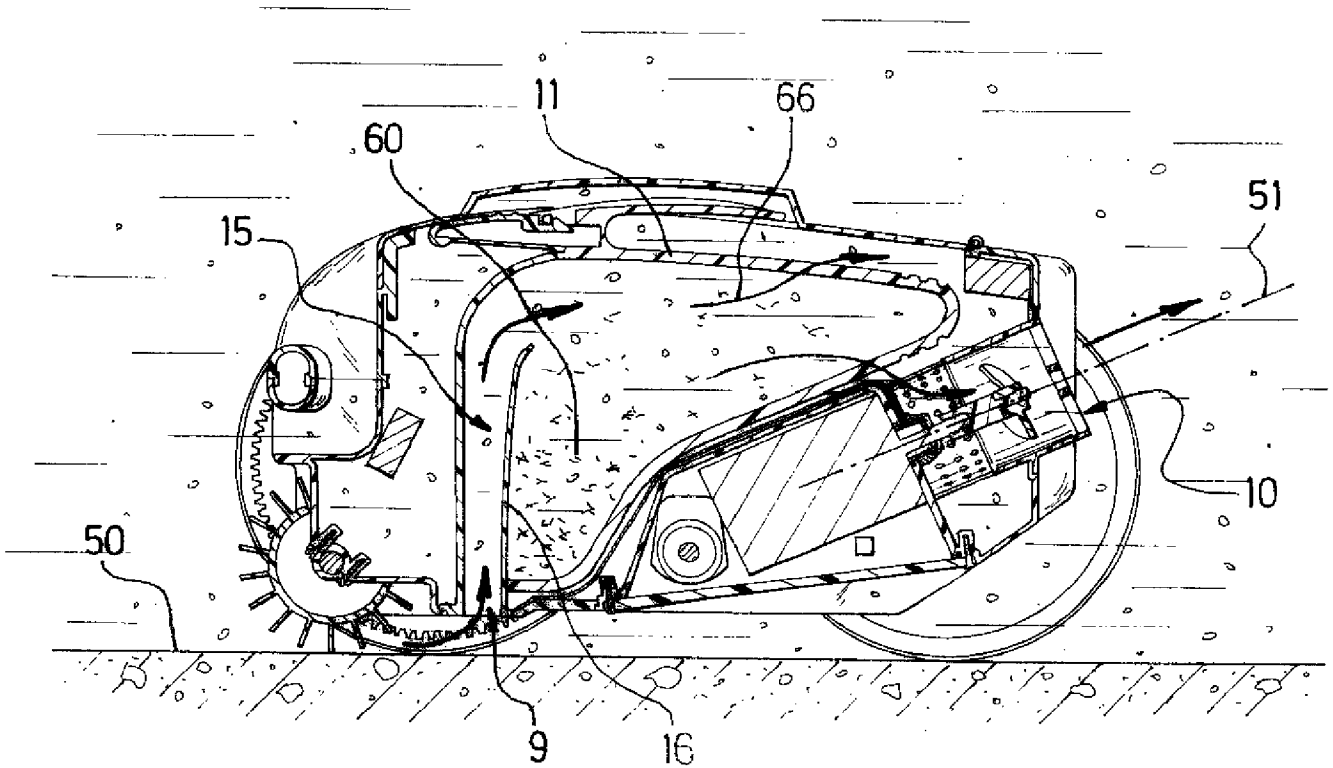

Other features, objectives and advantages of the invention will be appreciated from a reading of the following description which sets out by way of non-limiting example an embodiment of the invention, with reference to the appended drawings, in which:

FIG. 1 is a schematic perspective plan view of a cleaning device according to an embodiment of the invention, FIG. 2 is a schematic side view of a cleaning device according to an embodiment of the invention, FIG. 3 is a schematic section of a cleaning device according to an embodiment of the invention, FIG. 4 is a schematic rear view of a cleaning device according to an embodiment of the invention, FIG. 5 is a schematic view of a housing of a device according to an embodiment of the invention, FIG. 6 is a schematic perspective bottom view of a cleaning device according to an embodiment of the invention, FIG. 7 is a simplified schematic section of FIG. 3 illustrating the device during operation over an immersed surface.

In the Figures, the scales and the proportions are not strictly complied with for the purposes of illustration and clarity.

In all of the following detailed description with reference to the Figures, unless indicated otherwise, each component of the cleaning device is described as it is arranged when the device is moving normally over a horizontal immersed surface in a preferred direction of advance, relative to which the front and the rear of the device are defined.

A device according to the invention comprises a hollow body 1 and rolling members 2, 3, 4 for guiding and driving the hollow body 1 over an immersed surface in at least one preferred direction of advance and in a main direction of advance called the longitudinal direction, parallel with the immersed surface.

This hollow body 1 is formed principally by a concave housing which delimits a main chamber. This concave housing is, for example, produced by means of molding or rotational molding. This housing is preferably produced from a thermoplastic material, such as polyethylene, polypropylene, ABS, PMMA or any equivalent material.

This hollow body 1 has a central chamber 35 which is capable of receiving a filtration chamber. This central chamber 35 is delimited by a lower wall which extends in a substantially horizontal plane; by lateral walls 36 which generally extend in vertical planes; by a front wall 37 which generally extends in a vertical plane, orthogonal relative to the planes of the vertical lateral walls 36; and by a rear wall 38 which generally extends in a vertical plane orthogonal relative to the planes of the vertical lateral walls 36.

The lower wall has an opening which extends transversely in the region of the front wall 37 so that liquid is able to be introduced into the central chamber 35 via this lower transverse opening. This opening forms a liquid inlet 9 in the hollow body 1.

The rear wall 38 comprises a cylindrical opening which forms a liquid outlet 10 out of the hollow body 1. This liquid outlet 10 which is provided in the rear wall 38 of the housing is longitudinally offset from the liquid inlet 9 which is provided in the lower wall. Furthermore, this liquid outlet 10 is provided in the upper portion of the housing in such a manner that it is also vertically offset from the liquid inlet 9.

This central chamber 35, this liquid inlet 9 and this liquid outlet 10 form a filtration chamber 8. This filtration chamber 8 further comprises a hydraulic circuit which is capable of providing a flow of liquid between the liquid inlet 9 and the liquid outlet 10 through a filtering device 11.

Preferably, the liquid inlet 9 and the liquid outlet 10 are centered on the same longitudinal vertical center plane of the device.

The central chamber 35 of the hollow body 1 is capable of receiving a filtering device 11. The filtering device 11 is arranged between the liquid inlet 9 and the liquid outlet 10.

This filtering device 11 may be of any known type.

For example, the filtering device 11 comprises a rigid frame and a filtering sheet—in particular a filtering material—carried by this rigid frame. Such a filtering device 11 is therefore self-supporting and can be readily manipulated by a user.

The device also comprises a flap 6 for access to this filtering device. This access flap 6 forms an upper wall of the hollow body 1 and covers it. In the embodiment illustrated, this flap 6 is provided on the upper portion of the device in such a manner that a person using the device can readily open the flap 6 and remove the filtering device 11. There is nothing to prevent the access flap 6 from extending at least partially forwards. Preferably, the access flap 6 is articulated to the body 1 of the device by means of hinges 23 which are provided at the rear of the device.

Preferably, the filtering device 11 is a device which is mounted in the central chamber 35 of the hollow body 1 in the manner of a drawer. To this end, the rigid frame of the filtering device 11 has two ribs which extend laterally at each side of the filtering device 11. These ribs have shapes and dimensions which correspond to and complement the shapes and dimensions of grooves which are fixedly joined to the hollow body 1. These grooves which are fixedly joined to the hollow body 1 extend vertically along the inner faces of the vertical lateral walls of the hollow body 1. The ribs of the filtering device 11 are therefore capable of co-operating with the grooves of the hollow body 1 of the device.

In this manner, the removal of the filtering device 11 is the result of a translation movement of the filtering device 11 along the grooves of the hollow body 1. A user can therefore readily remove the filtering device 11 from the hollow body 1, for example, in order to clean it. After the filtering device 11 has been cleaned, a user can readily reintroduce the filtering device 11 into the hollow body 1 by orientating the filtering device 11 so that the ribs of the filtering device 11 are opposite the grooves of the hollow body, then by sliding the filtering device 11 in the hollow body 1.

The filtering device 11 further comprises a handle 28 which is provided on an upper portion of the filtering device 11 in order to facilitate handling of the filtering device 11. In particular, a user is able to readily assemble/disassemble the filtering device 11 using this handle 28 when the device is taken out of the liquid and is resting on a horizontal surface.

In the preferred embodiment of the invention illustrated in the Figures, the rolling members for guiding and driving the device comprise a front axle which comprises front drive wheels 2, one at each side, and a rear axle which comprises rear non-drive wheels 3, one at each side.

Furthermore, preferably and as illustrated in the Figures, the device comprises brushes 4 which are arranged at the front of the device. These brushes 4 are intended to brush the immersed surface and move the debris which are brushed towards the rear of the device in the direction of the liquid inlet 9 which is arranged below the device.

The device further comprises at least one electric motor 20 for driving the front drive wheels 2. Preferably, the device comprises two drive motors 20, one at each side, for independently driving each of the front wheels 2, respectively. To this end, each front wheel 2 has an internal toothed arrangement 5 which co-operates with a pinion 45 which is driven by the corresponding drive motor 20.

These brushes 4 may be of any type. According to one embodiment of the invention, the device comprises two coaxial front brushes 4. Each brush 4 is capable of being rotated about an axis which extends in a direction, which is called the transverse direction, and which is perpendicular relative to the longitudinal direction. Each brush 4 comprises a plurality of fins 41 which extend radially from a brush shaft which forms the rotation axis of the brush 4. The fins 41 are, for example, of rubber or a strong plastics material.

Furthermore, the brushes 4 are preferably also rotated by means of at least one electric motor 20 for driving the front wheels 2 by means of a gear system. According to this embodiment, the internal toothed arrangement 5 of each front drive wheel 2 co-operates with a pinion 42 which is fixed to one end of the shaft of a brush 4 so that a rotation of the wheel 2, by means of the toothed arrangement 5 and the pinion 42, brings about the rotation of the shaft of the brush 4 and therefore the rotation of the brush 4.

In this manner, in the embodiment illustrated, the rolling members are constituted by the front drive wheels 2, rear non-drive wheels 3 and brushes 4 which are involved in driving and guiding the device over the immersed surface. In any case, the rolling members 2, 3, 4 have zones which are intended to come into contact with the immersed surface and which are coplanar and define a theoretical rolling plane 50. The longitudinal direction of advance of the device is parallel with this theoretical rolling plane 50.

The front wheels 2 preferably have a diameter of between 100 mm and 500 mm, in particular between 150 mm and 250 mm. According to the embodiment of the Figures, the front wheels 2 have a diameter in the order of 200 mm. In this manner, these front wheels 2 facilitate the passing of obstacles and have improved traction. Advantageously, their peripheral tread is formed by or covered with an anti-skid material.

The front wheels 2 and the brushes 4 constitute front drive rolling members 2, 4 which protrude forwards relative to the other constituent elements of the device, in particular the hollow body, in order to form the extreme front portion of the device and first come into contact with an obstacle which is encountered during the forward movement.

Furthermore, according to a preferred embodiment of the invention, the device also comprises an operating handle 7 which allows a user to carry the device in order to immerse it in a liquid and remove it therefrom. This handle 7 is preferably arranged opposite the liquid outlet 10 so that, when the hollow body 1 is suspended via this handle, the device tilts spontaneously under the effect of gravity into a position in which the liquid outlet 10 is located below the liquid inlet 9, which allows the device to be emptied. When the device moves from the cleaning position to the emptying position, the debris drawn in by the device are retained in the filtering device and cannot be discharged from the device.

The flow of liquid in the hollow body 1 of the device is illustrated schematically in FIG. 7 by means of arrows 66. Liquid enters the hollow body 1 via the liquid inlet 9 which is arranged below the device. This liquid passes into a liquid inlet column 15 in order to reach the filtering device 11. This filtering device 11 has porous walls which are capable of allowing the liquid to pass through but of retaining the solid debris 60. The filtered liquid reaches the liquid outlet 10 and is discharged at the rear of the device into the pool from which it originates.

According to the preferred embodiment illustrated in the Figures, the inlet column 15 forms a non-return wall 16 which prevents the debris which have reached the filtering device 11 from being discharged via the liquid inlet 9 when the pump 12 is stopped.

A device according to the invention further comprises a motorized liquid pumping device which comprises an electric pumping motor 12 having a rotating drive shaft 13 which is coupled to a pumping propeller 14 which is interposed in the hydraulic circuit in order to generate therein a flow of liquid between the liquid inlet 9 and the liquid outlet 10 which are connected by means of this hydraulic circuit.

According to the invention, the pumping propeller 14 which is interposed in the hydraulic circuit between the liquid inlet 9 and the liquid outlet 10 has an inclined rotation axis which forms, with the longitudinal direction, an angle $\alpha$ which is not equal to zero and which is different from 90°.

The pumping propeller 14 is capable of generating a flow of liquid which is orientated along the axis 51 thereof towards the liquid outlet 10 in the direction away from the base of the hollow body 1.

Only the pumping propeller 14 is arranged in the hydraulic circuit so as to be able to provide the liquid flow. This pumping propeller 14 is arranged at the rear of the device, close to the liquid outlet 10. That is to say, the pumping propeller 14 and the liquid outlet 10 form the end portion of the hydraulic circuit.

Preferably, each pumping motor 12 has an inclined rotating drive shaft 13 which forms, with the longitudinal direction, the same angle $\alpha$ which is not equal to zero and which is different from 90°.

Preferably, the rotation axis 51 of the pumping propeller 14 which is interposed in the hydraulic circuit is parallel with the inclined middle direction which extends through the liquid inlet 9 and the liquid outlet 10 which are connected by this hydraulic circuit.

Consequently, the longitudinal displacement between the liquid inlet 9 and the liquid outlet 10 is determined by the inclination of the pump.

Preferably, the longitudinal displacement between the liquid inlet 9 and the liquid outlet 10 is greater than 50%—in particular 75%—of the overall size of the device in the longitudinal direction.

Consequently, the hydraulic circuit which connects this liquid inlet 9 and this liquid outlet 10 extends over more than 50%—in particular 75%—of the overall size of the device in the longitudinal direction.

With an equivalent height, the device has a greater length available for the hydraulic circuit, all other things being equal, which allows the deviations and the complexities of the hydraulic path and therefore the pressure losses to be minimized.

The selection of the angle $\alpha$ determines the vertical compactness of the device. A device according to the invention, owing to its inclined pumping axis, has a hydraulic drag which is reduced compared with a known device having a vertical pumping axis.

In the Figures, the angle $\alpha$ is in the order of 30° relative to the horizontal longitudinal direction.

Preferably, the transverse liquid inlet 9 provided in the lower wall of the housing has a cross-section which is substantially equal to the cross-section of the liquid outlet 10 which is provided in the rear wall of the housing.

This transverse liquid inlet 9 has a substantially rectangular shape whose length is approximately seven times the width. The liquid outlet 10 has a substantially circular shape whose radius is in the order of one and a half times the width of the liquid inlet 9.

There is nothing to prevent the provision of other sizes and other shapes for the cross-section of the liquid inlet and the liquid outlet.

The pumping motor 12 is accommodated in a sealed housing 17. This sealed housing 17 has an axial opening which allows the rotating drive shaft 13 to pass through. This opening is preferably sealed by means of an O-ring 18 which is arranged between the drive shaft 13 and the opening of the housing 17.

The pumping motor 12 is preferably supplied with electrical power by means of a sealed electrical cable which connects the device to a domestic electric network.

FIG. 1 illustrates the zone 19 where the electrical cable is introduced into the device. This cable for supplying electrical power to the pumping motor 12 is not illustrated in the Figures for the purposes of clarity.

The pumping motor may be of any known type.

According to a preferred embodiment, the pumping motor 12 is a low-voltage motor.

As indicated above, preferably, the movement of the device according to the invention over the immersed surface to be cleaned is produced by means of the front drive wheels 2. These front drive wheels 2 are rotated, for example, by means of an electric motor 20. This electric motor 20 is supplied with electrical power by the same electrical power supply cable as the pumping motor 12.

Preferably, each electric motor 20 is also arranged in the sealed housing 17 in which the pumping motor 12 is arranged.

Each electric motor is preferably a low-voltage electric motor.

It has been found that a device according to the invention which has an overall height of 250 mm and which is provided with a pumping motor with a power of 80 W can produce a flow of liquid in the order of 18 $m^3/h$. The total power consumed for the operation of this device driven at a mean speed in the order of 10 m/min is approximately 85 W. In comparison, a device in accordance with WO 0250388 which is provided with the same pumping motor and which has the same height produces a flow in the order of 15 $m^3/h$. Furthermore, the total power consumed for the operation of this prior device driven at the same mean speed is in the order of 105 W. It is therefore found that a device in accordance with the invention shows an improvement in performance levels of approximately 20% compared with a prior device comparable with WO 0250388.

Of course, the invention may involve numerous construction variants and applications.

For example, according to an embodiment which is not illustrated in the Figures, the device may comprise a plurality of liquid inlets, a plurality of liquid outlets and a plurality of hydraulic circuits, for example, one at the left-hand side and one at the right-hand side.

Furthermore, the sizing and the configuration of the device, in particular the hydraulic circuit thereof, are subject to an infinite number of variants. In addition, the invention can be used for a bi-directional device which is capable of backward movement.

The invention claimed is:

1. A swimming pool cleaner comprising:

a. a body comprising an inlet and an outlet and having a longitudinal axis and an upper section;

b. a filtering device positioned between the inlet and the outlet so as to filter water flowing therethrough;

c. a pumping motor comprising a rotating drive shaft;

d. an axial propeller (i) positioned between the inlet and the outlet, (ii) coupled to the rotating drive shaft, and (iii) having an axis of rotation inclined relative to the longitudinal axis at an angle other than zero or ninety degrees; and e. a flap connected to the upper section of the body and configured to be moveable so as to expose the filtering device and allow it to he removed from the body.

2. A swimming pool cleaner according to claim 1 in which (a) the body further comprises a lower section and a rear section, (b) the inlet is positioned in the lower section, and (c) the outlet is positioned in the rear section.

3. A swimming pool cleaner according to claim 2 in which (a) the lower section includes a lower wall, (b) the rear section includes a rear wall, and (c) the body has a central chamber defined by the lower wall, the rear wall, a front wall, and a plurality of lateral walls generally orthogonal to the rear and front walls.

4. A swimming pool cleaner according to claim 3 in which the axis of rotation of the axial propeller is inclined relative to the longitudinal axis at an angle of between 15-60 degrees.

* * * * *